US010633848B1

(12) United States Patent
Luper

(10) Patent No.: US 10,633,848 B1
(45) Date of Patent: Apr. 28, 2020

(54) TOILET FOR FACILITATING BOWEL MOVEMENTS

(71) Applicant: Albert R. Luper, Sarasota, FL (US)

(72) Inventor: Albert R. Luper, Sarasota, FL (US)

( * ) Notice: Subject to any disclaimer, the term of this patent is extended or adjusted under 35 U.S.C. 154(b) by 70 days.

(21) Appl. No.: 15/964,558

(22) Filed: Apr. 27, 2018

Related U.S. Application Data

(60) Provisional application No. 62/502,047, filed on May 5, 2017.

(51) Int. Cl.

| | |
|---|---|
| ***E03D 11/04*** | (2006.01) |
| ***A47K 13/28*** | (2006.01) |
| ***A47K 13/10*** | (2006.01) |
| *A47K 13/12* | (2006.01) |

(52) U.S. Cl.
CPC ..... *E03D 11/04* (2013.01); *A47K 13/10* (2013.01); *A47K 13/28* (2013.01); *A47K 13/12* (2013.01)

(58) Field of Classification Search
CPC ..... E03D 11/04; A47K 13/10; A47K 13/12; A47K 13/28
USPC ..... 4/237, 420
See application file for complete search history.

(56) References Cited

U.S. PATENT DOCUMENTS

| | | | | |
|---|---|---|---|---|
| 906,053 | A * | 12/1908 | McAuliffe | |
| 912,754 | A | 2/1909 | Stover | |
| 1,152,962 | A * | 9/1915 | Muckenhirn | E03D 11/02 4/421 |
| 1,155,885 | A | 10/1915 | Catchings | |
| 2,036,984 | A | 4/1936 | Salvoni | |
| 2,099,118 | A | 11/1937 | Kennedy | |
| 3,520,005 | A | 7/1970 | Downes | |
| 3,786,522 | A | 1/1974 | Kira et al. | |
| 4,175,294 | A | 11/1979 | Boyd | |
| 4,233,696 | A | 11/1980 | Ibel | |
| 4,254,514 | A | 3/1981 | Sakamoto | |
| 4,457,029 | A | 7/1984 | Matthews | |
| D342,122 | S * | 12/1993 | Jensen | D23/295 |
| 5,553,334 | A | 9/1996 | Hillman | |
| D608,427 | S * | 1/2010 | Sanchez | D23/301 |
| 8,978,171 | B1 | 3/2015 | Wise | |
| 10,292,549 | B2 * | 5/2019 | Kim | A47K 17/02 |
| 2008/0222783 | A1 | 9/2008 | Mattioli | |
| 2011/0179563 | A1 | 7/2011 | Chern et al. | |

OTHER PUBLICATIONS

U.S. Appl. No. 29/603,023, Luper.

* cited by examiner

*Primary Examiner* — Huyen D Le
(74) *Attorney, Agent, or Firm* — Frijouf, Rust & Pyle, P.A.

(57) ABSTRACT

A toilet for facilitating bowel movements comprising a toilet base having a bowl for receiving the human waste and a rim for supporting the human. The rim defines a generally circular shape having a proximal edge, a primary side edge, a secondary side edge and a distal edge. The proximal edge defines a first elevation. The distal edge defines a second elevation. The second elevation has a greater elevation than the first elevation for defining an ascending slope from the proximal edge and the distal edge. The ascending slope positions the human in a squatting position while defecating for improving the bowel movement from the human.

8 Claims, 5 Drawing Sheets

TOILET FOR FACILITATING BOWEL MOVEMENTS

CROSS-REFERENCE TO RELATED APPLICATIONS

This application claims benefit of U.S. Patent Provisional application No. 62/502,047 filed May 5, 2018. All subject matter set forth in provisional application No. 62/502,047 is hereby incorporated by reference into the present application as if fully set forth herein.

BACKGROUND OF THE INVENTION

Field of the Invention

This invention relates to toilets and more particularly to a toilet for facilitating bowel movements.

Background of the Invention

It is believed that defecating in a sitting posture may lead to negative health issues including constipation, hemorrhoids, colon disease and urinary difficulty and infections. These negative health issues may be attributable by a partially relaxed puborectalis muscle while in the sitting posture. The puborectalis muscle encircles the colon and forms a sling. The puborectalis muscle pulls the rectum forward to create an angle, referred to as the ano-rectal angle, between the rectum and the anal canal. While in the sitting posture, the puborectalis muscle is only partially relaxed causing a large ano-rectal angle and thus a restricted path for the stool to pass through the anal canal. While in the squatting position, the puborectalis muscle is substantially relaxed causing a less ano-rectal angle and thus a more straight path for the stool to pass through the anal canal.

It is believed that positioning the human in a more squatting position while defecating would lead to positive health issues including less constipation, hemorrhoids, colon disease and less urinary difficulties and infections. There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 912,754 to Stover discloses a water closet having a saddle-shaped seat open at both front and rear ends.

U.S. Pat. No. 1,155,885 to Catchings discloses a water toilet bowl having the upper edge thereof formed after the fashion of a saddle and having relatively high back and front pieces and foot rests formed integral with the outer surface of the ball. Each of the rests are provided with a flat horizontal portion to receive the ball of the foot and a second flat portion arranged at a lower elevation for receiving the heel of the user in combination with the flushing mechanism having a portion thereof is slidably mounted in the heel receiving portion of one of the rests.

U.S. Pat. No. 2,036,984 to Salvoni discloses a bidet adapted to be placed on top of a toilet comprising a bowl. The bidet has a useful pain and portion peripherally extending at least to the outer edge of the rim of the bowl and forwardly extending beyond the bowl.

U.S. Pat. No. 2,099,118 to Kennedy discloses a toilet assembly comprising a toilet bowl formed with an upper edge curved from the front to the rear, a toilet seat conforming in curvature to the upper edge of the bowl and a back member carried by the bowl.

U.S. Pat. No. 3,520,005 to Downes discloses a toilet seat structure comprising a one piece generally annular seat having a top surface elevated at the front thereof and a complementarily configured lid for abutting the seat.

U.S. Pat. No. 3,786,522 to Kira et al. discloses a defecation process substantially faciltated by means of a specially contoured toilet seat which is completely adaptable to conventional toilets. The toilet seat has a hinge means for attachment to the toilet and an annular relatively planar section, conforming generally in peripheral configuration to the periphery of the bowl section of the toilet. The hinge post section positioned at the rear end of the toilet. The rear section of the toilet is upwardly and outwardly curved at a steep angle thereby preventing the user from sitting back on the rear section of the toilet seat. The top surfaces of the seat in the rear and side sections slope in an upwardly and outward direction but at a progressively smaller angle than the rear most section. At the front section of the seat particularly in the thigh support region, the surface of the seat is somewhat concave and in a region of the front section the seat slopes in a direction which is the reverse of the slope at the side and rear sections.

U.S. Pat. No. 4,175,294 to Boyd discloses an improved toilet construction using a bulbous upwardly rounded portion at the forward end of a toilet seat to raise the user's thighs angularly upward from a horizontal position and an angled foot engaging means at the lower forward portion of the toilet bowl to raise the user's feet angularly upwardly from a horizontal disposition. The combination of the upwardly rounded portion and the foot engaging means causes the user's feet to be disposed at an angle between about 30.degree. and about 60.degree. with respect to the floor and causes the user's legs to assume a position where the angle between the user's calf and thigh is between about 40.degree. and about 50.degree.

U.S. Pat. No. 4,233,696 to Ibel discloses a semi-squat having enlarged inward sloping opposite middle portions for the supportive engagement of the user's thighs and an opening including enlarged front and rear portions and a relatively narrow middle portion. The lack of any support areas in the front and rear portions of the toilet seat in combination with the inwardly sloped configuration of the enlarged opposite middle portions positions the user into a semi-squat position, thighs and buttocks spread apart, legs angled upwardly, body bent forward at the waist, over the middle portion of a toilet bowl. The enlarged front and rear portions of the opening allow the insertion of the hand for blotting and wiping and prevent soiling.

U.S. Pat. No. 4,254,514 to Sakamoto discloses a horizontal seat member defining a central vertical opening therethrough is provided for stationary support from the open upper end of a toilet bowl. The seat member includes front, rear and opposite side portions and defines an upper seat surface which is upwardly concave in a front-to-rear extending direction for more readily conforming to the lower torso configuration of a person having his or her legs bent sharply in positions similar to those assumed when the person is in a squatting position. The forward extremity of the seat member includes a depending portion terminating downwardly in a forwardly and horizontally directed footrest portion for support of the user's feet and the seat member has a hinged cover operatively associated therewith, the cover including first and second sections thereof pivotally joined together along adjacent marginal portions and being swingable between a raised upstanding open position with the cover sections substantially coplanar and a lowered horizontal position with the cover sections relatively oppositely inclined downwardly toward the adjacent marginal edges thereof to more closely conform to the concave seat member. The cover includes structure thereon for releasably retaining the cover sections in the coplanar position thereof.

U.S. Pat. No. 4,457,029 to Matthews discloses an annular toilet seat having a top surface that includes a raised forward segment and a raised rear segment in which the rear segment is raised to a higher level than the forward segment. Inclined segments referred to as intermediate segments bridge the forward and rear segments. A heart shaped contour line indicating the edge of the highest level points extends through the central region of the forward and rear segments and along the central opening in the intermediate segments. The raised rear segment provides comfort and aids in elimination.

U.S. Pat. No. 5,553,334 to Hillman discloses a curved toilet bowl specifically adapted to protect a user's colon including a bowl having a first side, a second side, a forward portion, a rearward portion, and an oval upper opening having a forward extent and a rearward extent. The bowl further includes a lower base and a hollow interior. The oval upper opening slopes gradually upwardly from the rearward extent to forward extent. The upper opening also has a peripheral thickness which increases from the rearward extent to the forward extent. The forward extent of upper opening functions to support the knees and the underside of the upper legs of the user. The footrest has a top surface, an upwardly inclined forward portion, and a rearward portion. The rearward portion includes a recessed edge. The recessed edge is specifically adapted to be removably secured to the lower base of the bowl.

U.S. Pat. No. 8,978,171 to Wise discloses an apparatus for use with an existing Western-style toilet having a toilet bowl facilitates use of a squatting posture thereon. The apparatus includes a platform assembly including: a mounting flange that is connectable to the toilet bowl, and a support platform that is pivotally connected to the mounting flange. The support platform defines first and second spaced-apart foot support surfaces to support a person's feet and a gap through which the person's waste products can pass.

United States Patent Application 2008/0222783 to Mattioli discloses a sanitary article, in particular a toilet with a form that permits a physiologically correct position for defecation, and is so practical that it can be used even by elderly or disabled persons. This toilet, which is a type that ensures that angle .alpha., formed by the femur with the lumbosacral segment of the rachis, is less than 90.degree., is characterized by the fact that it provides a means of supporting said user's body, so that no burden is placed on the lower limbs, allowing the user to assume a position where the knees are higher than the pelvis, so that the knee joint is approximately at the height of the diaphragm United States Patent Application 2011/0179563 to Chern et al. discloses a water closet (WC) or toilet bowl usable in either in the: 1) sitting, 2) front facing squatting, or 3) rear facing squatting postures. The WC consists of an elongated receptacle similar in ratio of length to width to an eastern squatting-type WC, with shrouds at each end to contain urine spray and footrests on each side, at a slightly lower level than the receptacle, but at such a height above the floor that mounting the footrests is not uncomfortably precarious. The volume below the receptacle and footrests is used for a cistern, fed from a normal pressurised water supply, so that the flush water source is near the siphon jet entrance at the front part of the S-bend. A hinged seat, of suitable thickness/height so that when folded down and resting on the receptacle, forms a suitably high ring-shaped sitting surface.

Although the aforementioned prior art have contributed to the development of the art of positioning the human in a more squatting position while defecating, none of these prior art patents have solved the needs of this art.

Therefore, it is an object of the present invention to provide an improved toilet for positioning the human in a more squatting position while defecating.

Another object of this invention is to provide an improved toilet that effectively flushes the urine and stool from the toilet bowl.

Another object of this invention is to provide an improved toilet that is cost effective to produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved toilet for facilitating bowel movements. A water conduit is coupled to the toilet for inputting water into the toilet. A human discharges human waste into the toilet. The water flushes the human waste from the toilet. The toilet comprises a toilet base having a bowl for receiving the human waste and a rim for supporting the human. A water inlet is in the toilet base for receiving the water. A water conduit is in the toilet base and adjacent to the rim. A plurality of rim apertures are in the toilet base and are coupled with the water conduit for inputting the water into the bowl. A water outlet is in the toilet base for outputting the human waste and the water from the bowl. The rim defines a generally circular shape having a proximal edge, a primary side edge, a secondary side edge and a distal edge. The proximal edge defines a first elevation. The distal edge defines a second elevation. The second elevation has a greater elevation than the first elevation for defining an ascending slope from the proximal edge and the distal edge. The ascending slope positions the human in a squatting position while defecating for improving the bowel movement from the human.

In a more specific embodiment of the invention, the plurality of rim apertures define an increasing diameter from the proximal edge to the distal edge for producing a more consistent output of the water from the plurality of rim apertures with the ascending slope.

In a more specific embodiment of the invention, the ascending slope in the proximal edge, the primary side edge, the secondary side edge and the distal edge defines a linear ascending surface.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
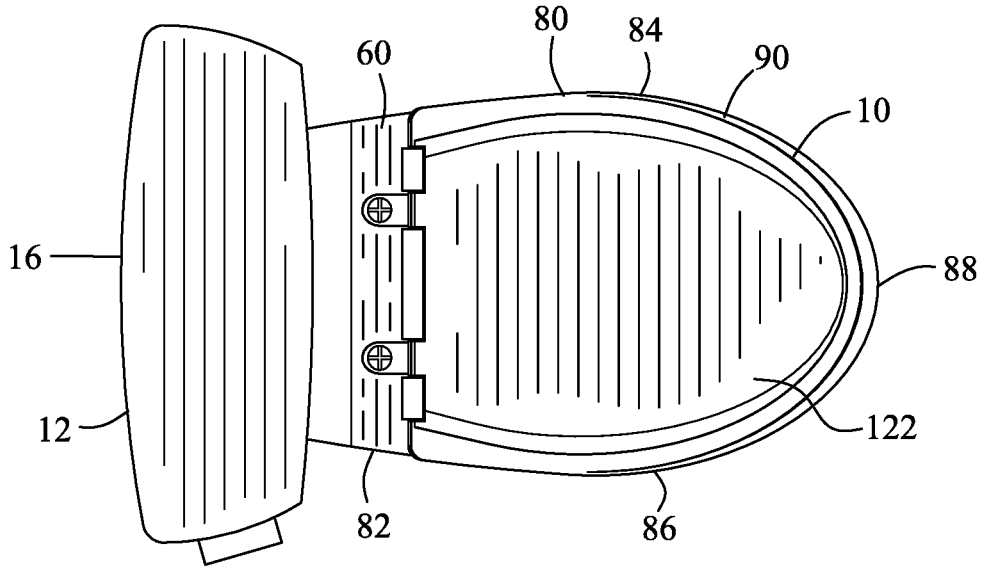
FIG. 1 is a top view of a toilet for facilitating bowel movements incorporating the present invention.
Figure 2:
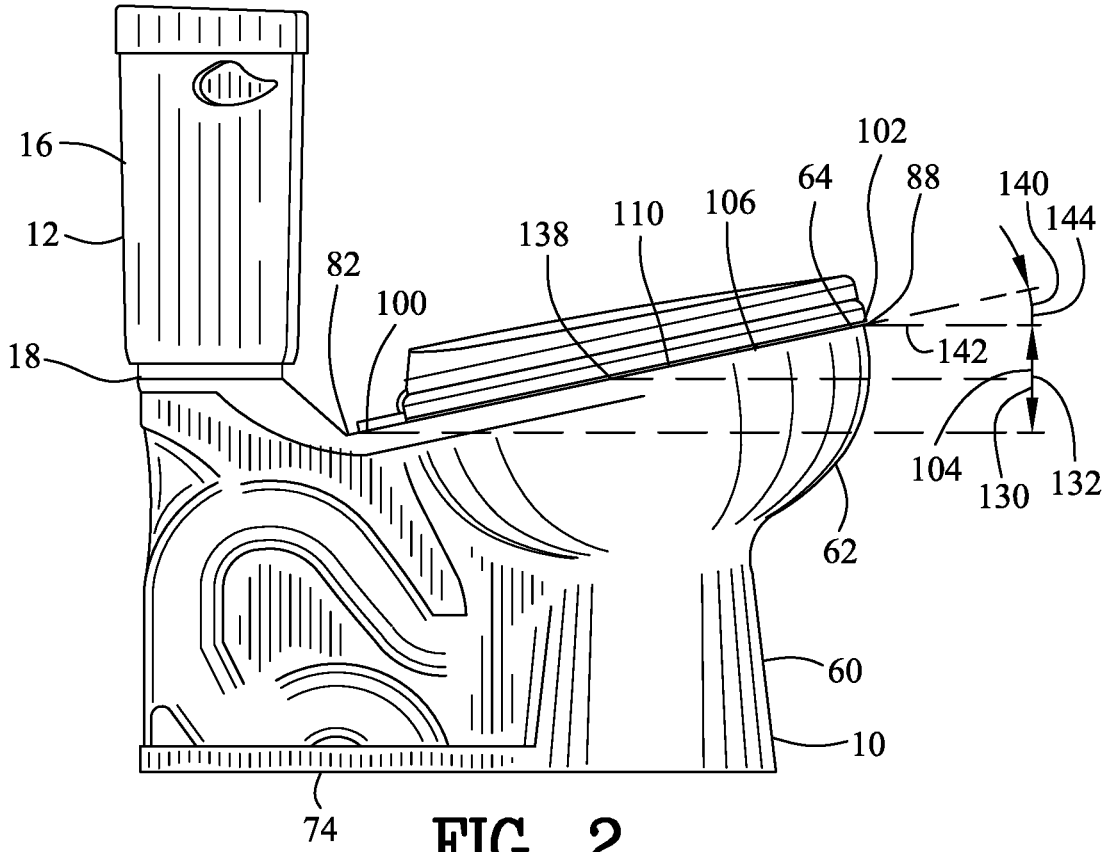
FIG. 2 is a left side view of FIG. 1 illustrating the toilet having an ascending slope.
Figure 3:
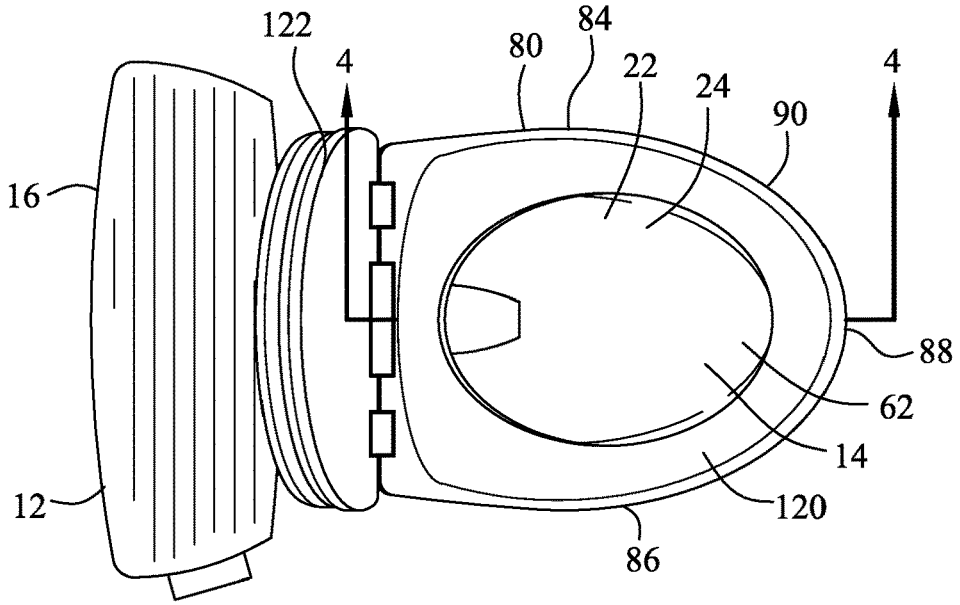
FIG. 3 is a view similar to FIG. 1 wherein a toilet lid is pivoted in a substantial vertical position for exposing a toilet seat.
Figure 4:
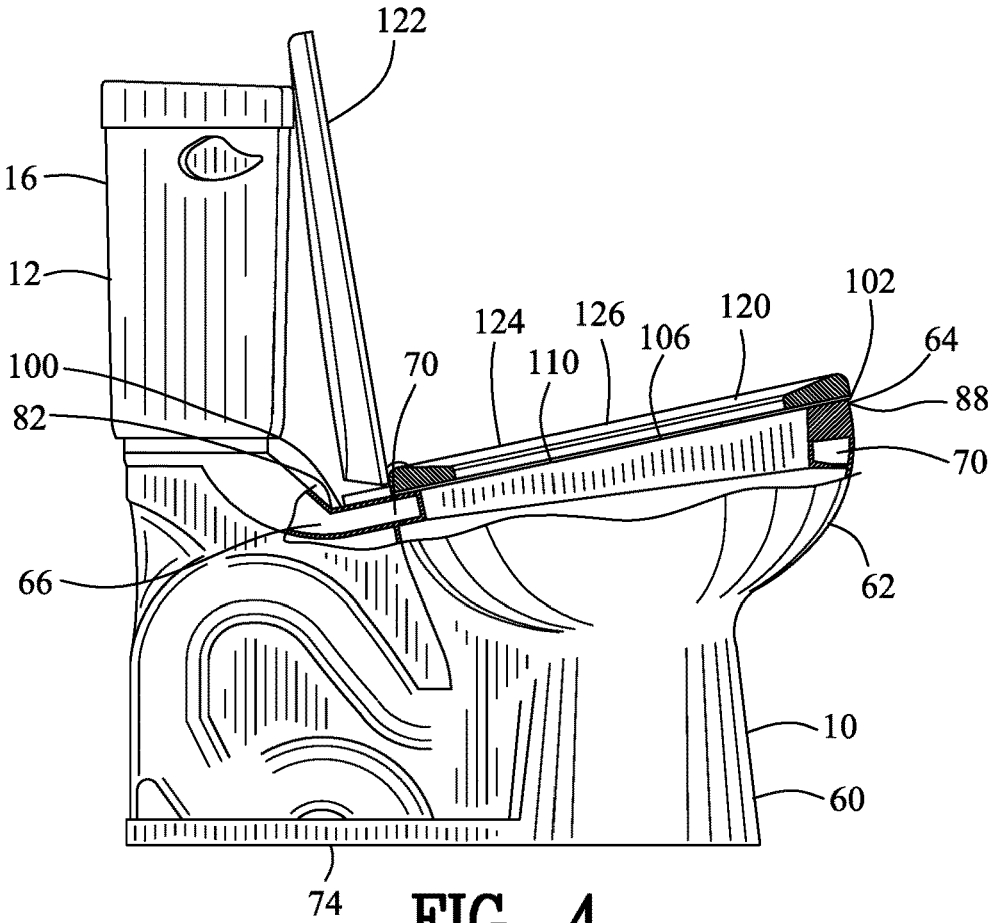
FIG. 4 is a left side view of FIG. 3 illustrating a partial sectional view along line 4-4 in FIG. 3.
Figure 5:
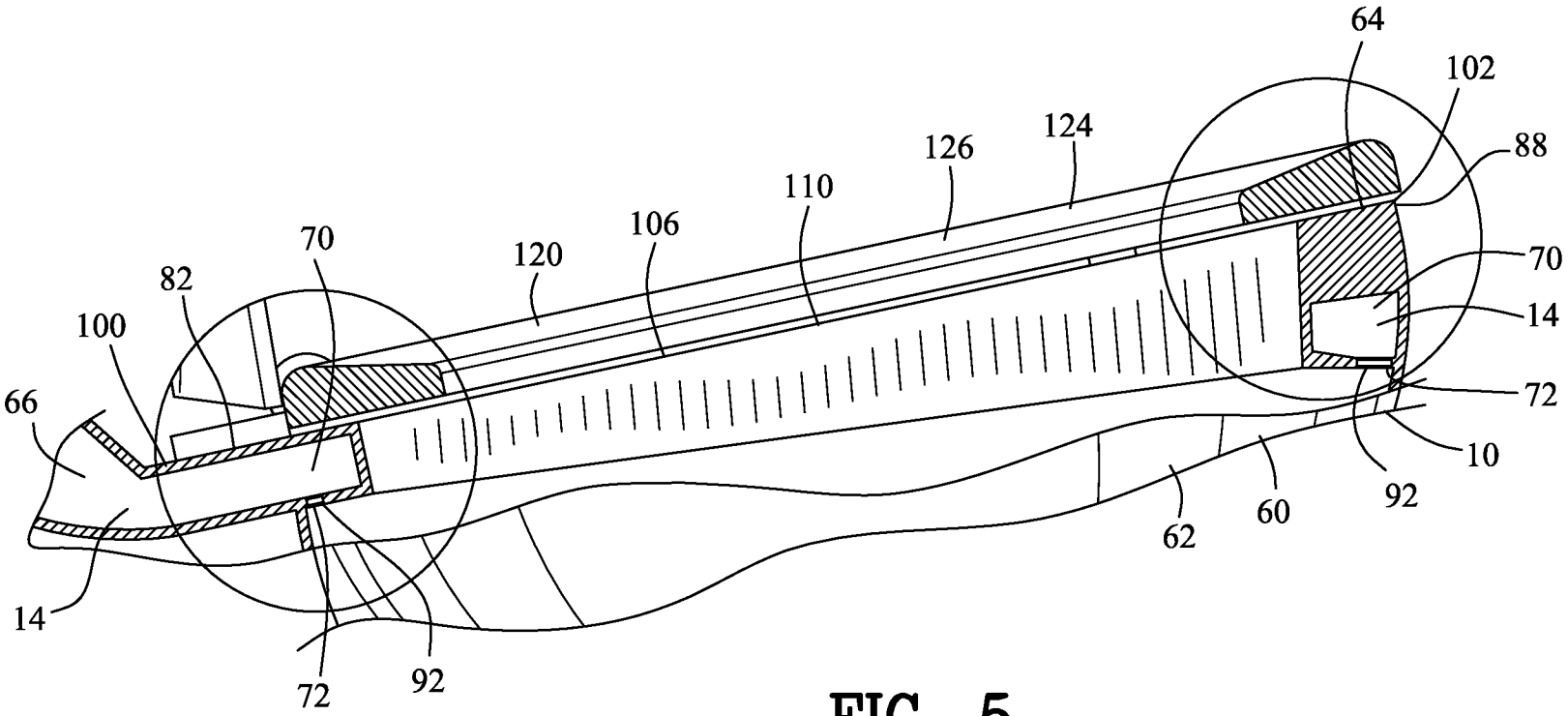
FIG. 5 is an enlarged portion of FIG. 4 illustrating a rim extending between a proximal edge to a distal edge.
Figure 6:
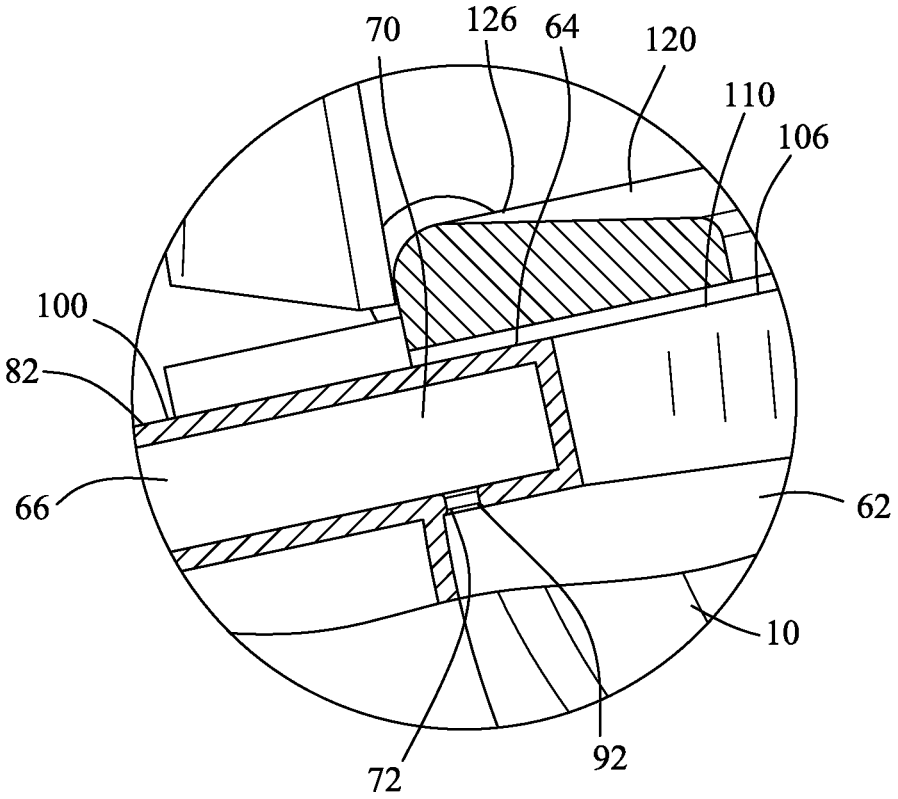
FIG. 6 is an enlarged portion of FIG. 5 illustrating a first diameter rim aperture in the proximal edge of the rim.
Figure 7:
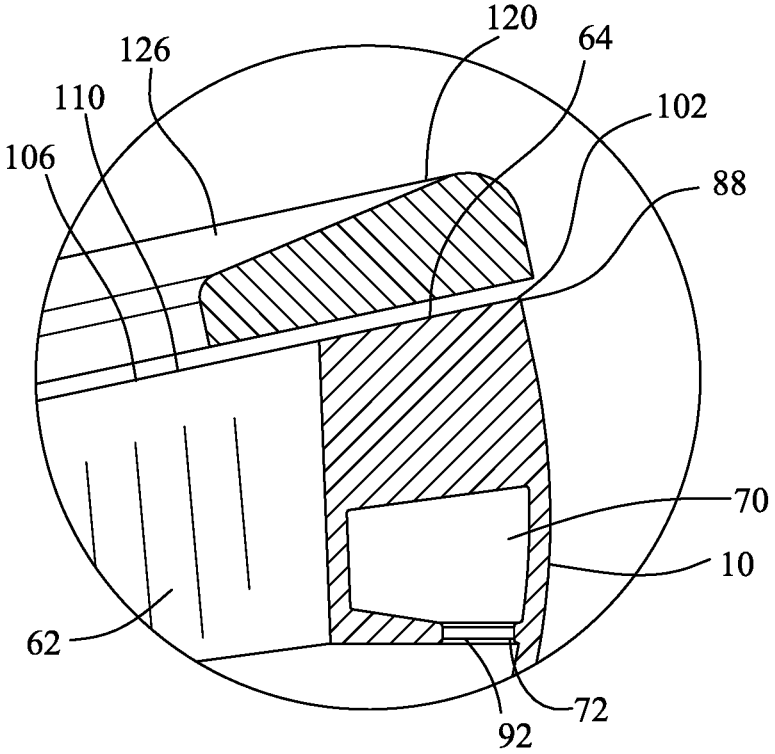
FIG. 7 is an enlarged portion of FIG. 5 illustrating a second diameter rim aperture in the distal edge of the rim.

FIGS. 1-8 illustrate a toilet 10 for facilitating bowel movements. A water conduit 12 is coupled to the toilet 10 for inputting water 14 into the toilet 10. A water tank 16 may be coupled to a toilet base 60 wherein the water conduit 12 is between the water tank 16 and the toilet base 60. Alternatively, a water pipe 18 may be coupled to a toilet base 60 wherein the water conduit 12 is between the water pipe 18 and the toilet base 60. A human 20 discharges human waste 22 namely stool 24 into the toilet 10. The water 14 flushes the human waste 22 from the toilet 10.

Figure 9:
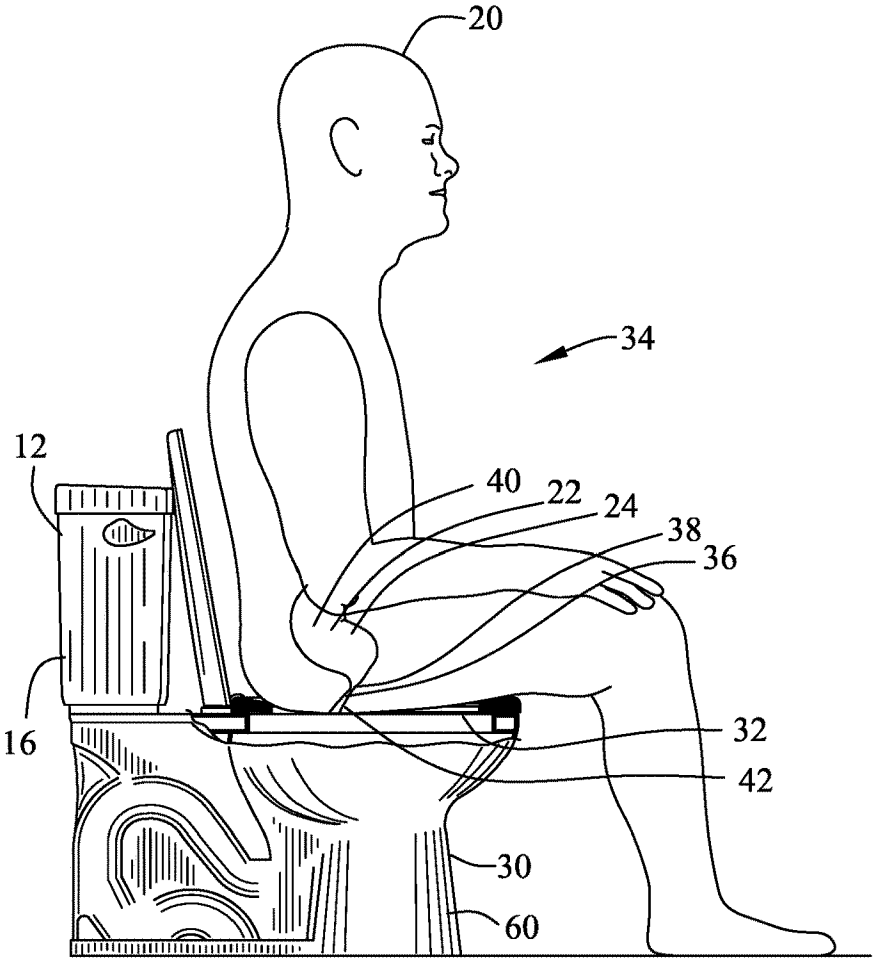
FIG. 9 illustrates a toilet having a horizontal rim positioning the human in a sitting position resulting in the puborectalis muscle in only a partially relaxed condition causing a large ano-rectal angle and thus a restricted path for the stool to pass through the anal canal.

FIG. 9 illustrates a standard toilet 30 with a horizontal rim 32. The horizontal rim 32 positions the human 20 in a sitting posture 34. It is believed the sitting posture 34 results in only a partially relaxed puborectalis muscle 36 causing a large ano-rectal angle 38 and thus a restricted path for the stool 24 to pass from the colon 40 to the rectum 42.

Figure 8:
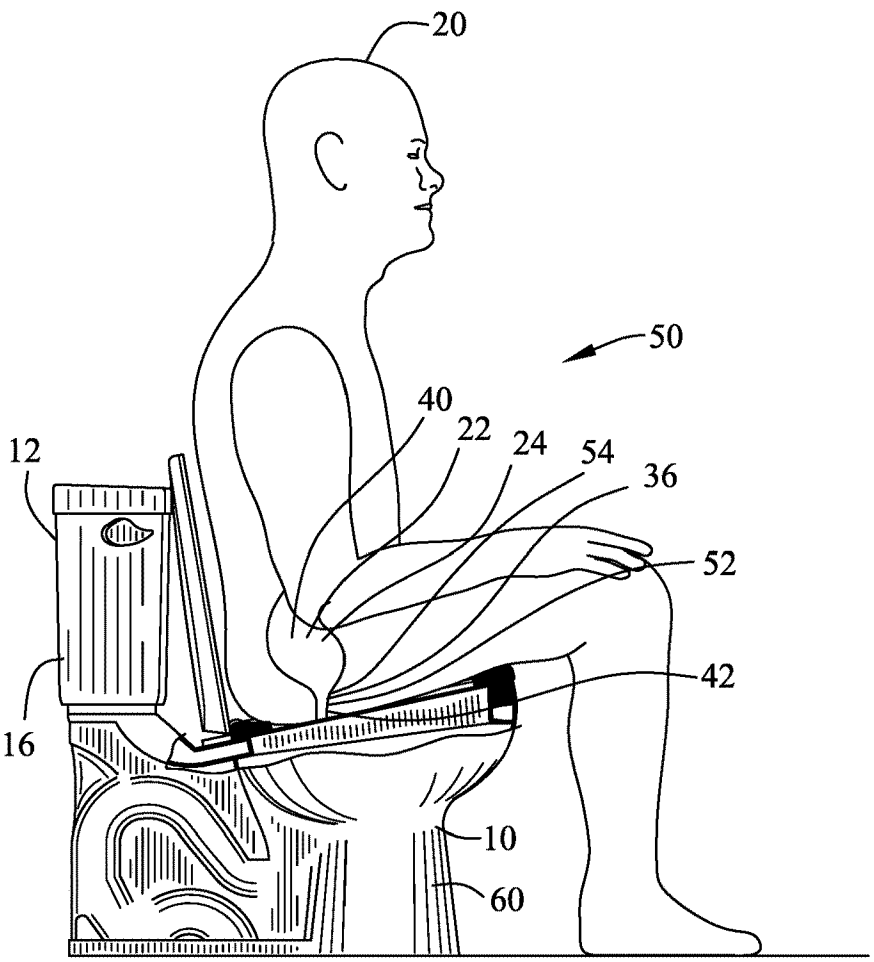
FIG. 8 is a view similar to FIG. 4 illustrating the ascending slope positioning a human in a squatting position resulting in the puborectalis muscle in a substantially relaxed condition causing a less ano-rectal angle and thus a more straight path for the stool to pass through the anal canal.

As shown in FIG. 8, the toilet 10 of the present invention positions the human 20 in a squatting position 50. It is believed the squatting position 50 results in the puborectalis muscle 36 being substantially relaxed causing a less ano-rectal angle 52 and thus a more straight path 54 for the stool 24 to pass from the colon 40 to the rectum 42.

The toilet 10 comprises the toilet base 60 having a bowl 62 for receiving the human waste 22 and a rim 64 for supporting the human 20. A water inlet 66 is in the toilet base 60 for receiving the water 14. A water conduit 70 is in the toilet base 60 and is adjacent to the rim 64. A plurality of rim apertures 72 are in the toilet base 60 and are coupled to the water conduit 70 for inputting the water 14 into the bowl 62. A water outlet 74 is in the toilet base 60 for outputting the human waste 22 and the water 14 from the bowl 62.

The toilet 10 preferably includes manufacturing dimensions that conform to existing industry standards as they relate to the installation and plumbing rough-ins. The toilet 10 can be installed as a new construction toilet or a replacement construction toilet for a toilet manufactured under standard industry specifications. More specifically, the toilet 10 can replace any existing toilet without alternating existing plumbing dimensions such as plumbing rough in, setbacks or other constructed dimensions.

The rim 64 defines a generally circular shape 80 having a proximal edge 82, a primary side edge 84, a secondary side edge 86 and a distal edge 88. Alternatively, the rim 64 may define a generally elliptical shape 90. The proximal edge 82 defines a first elevation 100. The distal edge 88 defines a second elevation 102. The second elevation 102 has a greater elevation 104 than the first elevation 100 for defining an ascending slope 106 from the proximal edge 82 and the distal edge 88. The ascending slope 106 positions the human 20 in the squatting position 50 while defecating for improving the bowel movement from the human 20. In addition, the ascending slope 106 positions the human 20 in the squatting position 50 for improving access for hygiene. More specifically, by positioning the human 20 in the squatting position 50 the human 20 is tilted forward and provides more exposed area in and around the rectum 42 for wiping and cleaning.

As best shown in FIGS. 4-7, the plurality of rim apertures 72 may include an ascending slope between the proximal edge 82 and the distal edge 88. The ascending slope of the plurality of rim apertures 72 may be similar or dissimilar to the ascending slope 106 of the rim 64. The plurality of rim apertures 72 may define an incremental increasing diameter 92 from the proximal edge 82 to the distal edge 88. The incremental increasing diameter 92 assists in producing a more consistent output of the water 14 around the entire circumference of the rim 64 from the plurality of rim apertures 72 with the ascending slope 106.

Alternatively, the plurality of rim apertures 72 may include a non-ascending slope or define a level orientation between the proximal edge 82 and the distal edge 88. Preferably, the plurality of rim apertures 72 define an equivalent diameter from the proximal edge 82 to the distal edge 88 where the plurality of rim apertures 72 have a non-ascending slope or a level orientation. The equivalent diameter assists in producing a more consistent output of the water 14 around the entire circumference of the rim 64 from the plurality of rim apertures 72 with the non-ascending slope or level orientation.

Preferably, the ascending slope 106 in the proximal edge 82, the primary side edge 84, the secondary side edge 86 and the distal edge 88 define a linear ascending surface 110. Alternatively, the ascending slope 106 in the proximal edge 82, the primary side edge 84, the secondary side edge 86 and the distal edge 88 may define a non-linear ascending surface, curves or a plurality of linear ascending surfaces not have an overall linear orientation.

The plurality of rim apertures 72 may include an angled orientation or non-vertical orientation relative to the rim 64. The angled orientation or non-vertical orientation assists in directionally jetting the water in a circular pattern and creating a vortex within the bowl 62.

A toilet seat 120 and toilet lid 122 may be pivotably coupled to the toilet base 60 for supporting the human 20. A standard toilet seat and a toilet lid may be utilized with the toilet 10 of the present invention. The toilet seat 120 and the rim 64 define a general parallel orientation 124 for defining a second ascending slope 126 in the toilet seat 120. The second ascending slope 126 positions the human 20 in the squatting position 50 while defecating for improving the bowel movement from the human 20.

The ascending slope 106 may include a range of one quarter inch (0.25") to ten inches (10") 130 between the proximal edge 82 and the distal edge 88. For example, the ascending slope 106 may include a four inch displacement 132 between the proximal edge 82 and the distal edge 88. The rim 64 includes a midpoint 134 between the proximal edge 82 and the distal edge 88. The proximal edge 82 decreases in elevation by two inches from the midpoint 134. Similarly, the distal edge 88 increases in elevation by two inches from the midpoint 134.

The ascending slope 106 may include a range of one (1) degree to thirty (30) degrees 140 in angular position of the rim 64 relative to a horizontal plane 142. For example, the ascending slope 106 includes twelve degrees 144 in angular position of the rim 64 relative to a horizontal plane 142.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A toilet for facilitating bowel movements, a water conduit coupled to the toilet for inputting water into the toilet, a human discharging a human waste into the toilet, the water flushing the human waste from the toilet, the toilet, comprising:

a toilet base having a bowl for receiving the human waste and a rim for supporting the human;

a water inlet in said toilet base for receiving the water;

a water conduit in said toilet base and adjacent to said rim;

a plurality of rim apertures in said toilet base and coupling to said water conduit for inputting the water into said bowl;

a water outlet in said toilet base for outputting the human waste and the water from said bowl;

said rim defining a generally circular shape having a proximal edge, a primary side edge, a secondary side edge and a distal edge;

said proximal edge defining a first elevation;

said distal edge defining a second elevation;

said second elevation having a greater elevation than said first elevation for defining an ascending slope from said proximal edge and said distal edge;

said ascending slope positioning the human in a squatting position while defecating for improving the bowel movement from the human; and said plurality of rim apertures defining an increasing diameter from said proximal edge to said distal edge for producing a more consistent output of the water from said plurality of rim apertures with said ascending slope.

2. A toilet for facilitating bowel movements as set forth in claim 1, wherein said ascending slope in said proximal edge, said primary side edge, said secondary side edge and said distal edge defining a linear ascending surface.

3. A toilet for facilitating bowel movements as set forth in claim 1, further including a toilet seat coupled to said toilet base for supporting the human;

said toilet seat and said rim defining a general parallel orientation for defining a second ascending slope in said toilet seat; and said second ascending slope positioning the human in a squatting position while defecating for improving the bowel movement from the human.

4. A toilet for facilitating bowel movements as set forth in claim 1, wherein said ascending slope includes a range of one quarter inch to ten inches between said proximal edge and said distal edge.

5. A toilet for facilitating bowel movements as set forth in claim 1, wherein said ascending slope includes a fourinch displacement between said proximal edge and said distal edge.

6. A toilet for facilitating bowel movements as set forth in claim 1, wherein said ascending slope includes a range of one degree to thirty degrees in angular position of said rim.

7. A toilet for facilitating bowel movements as set forth in claim 1, wherein said ascending slope includes a twelve degrees in angular position of said rim.

8. A toilet for facilitating bowel movements, a water conduit coupled to the toilet for inputting water into the toilet, a human discharging a human waste into the toilet, the water flushing the human waste from the toilet, the toilet, comprising:

a toilet base having a bowl for receiving the human waste and a rim for supporting the human;

a water inlet in said toilet base for receiving the water;

a water conduit in said toilet base and adjacent to said rim;

a plurality of rim apertures in said toilet base and coupling to said water conduit for inputting the water into said bowl;

a water outlet in said toilet base for outputting the human waste and the water from said bowl;

said rim defining a generally circular shape having a proximal edge, a primary side edge, a secondary side edge and a distal edge;

said proximal edge defining a first elevation, said distal edge defining a second elevation;

said second elevation having a greater elevation than said first elevation for defining an ascending slope from said proximal edge and said distal edge;

said ascending slope positioning the human in a squatting position while defecating for improving the bowel movement from the human;

said plurality of rim apertures defining an increasing diameter from said proximal edge to said distal edge for producing a more consistent output of the water from said plurality of rim apertures with said ascending slope; and said ascending slope in said proximal edge, said primary side edge, said secondary side edge and said distal edge defining a linear ascending surface.

* * * * *